US005911331A

United States Patent [19]

Boller

[11] Patent Number: 5,911,331

[45] Date of Patent: Jun. 15, 1999

[54] DOME LID FOR DRINKING CUP

[75] Inventor: Peter K. Boller, North York, Canada

[73] Assignee: Lily Cups Inc., Scarborough, Canada

[21] Appl. No.: 09/031,593

[22] Filed: Feb. 27, 1998

[51] Int. Cl.[6] ..... A47G 19/22

[52] U.S. Cl. ..... 220/254; 220/269; 220/712; 220/832; 220/835

[58] Field of Search ..... 220/254, 269, 220/270, 711, 712, 713, 714, 715, 703, 780, 782, 793, 831, 832, 834, 835, 837

[56] References Cited

U.S. PATENT DOCUMENTS

| | | | |
|---|---|---|---|
| 3,912,118 | 10/1975 | Bird . | |
| 3,952,910 | 4/1976 | Wheeler . | |
| 4,202,459 | 5/1980 | DeParales et al. . | |
| 4,322,015 | 3/1982 | Bailey | 220/712 |
| 4,441,624 | 4/1984 | Sokolowski . | |
| 4,589,569 | 5/1986 | Clements . | |
| 4,738,373 | 4/1988 | DeParales | 220/712 X |
| 4,741,450 | 5/1988 | Braude | 220/712 |
| 4,753,365 | 6/1988 | Seppala | 220/712 |
| 5,111,961 | 5/1992 | Van Melle | 220/712 |
| 5,183,172 | 2/1993 | Boller | 220/712 X |
| 5,197,624 | 3/1993 | Dodaro | 220/712 X |
| 5,392,949 | 2/1995 | McKenna | 220/712 |
| 5,503,289 | 4/1996 | Fox | 220/712 X |
| 5,613,619 | 3/1997 | Van Melle | 220/712 |
| 5,657,898 | 8/1997 | Portman et al. | 220/712 |
| 5,699,927 | 12/1997 | Lane et al. | 220/712 X |

FOREIGN PATENT DOCUMENTS

| | | |
|---|---|---|
| 52648 | 3/1984 | Canada . |
| 55550 | 1/1986 | Canada . |
| 1229576 | 11/1987 | Canada . |

*Primary Examiner*—Stephen K. Cronin
*Assistant Examiner*—Nathan Newhouse
*Attorney, Agent, or Firm*—Trevor C. Klotz

[57] ABSTRACT

A plastic dome lid for a drinking cup is disclosed which has the capability of functioning as a complete closure lid for the cup and as a drink through lid employing a recloseable flip-open lid segment for this purpose. The dome lid is provided with a lower section that has a downwardly facing annular channel for receiving and engaging the rim of the cup and an upper section which includes a raised C-shaped dome. An intermediate section is provided between the upper and lower sections forming a central area located within and depressed relative to the C-shaped dome. A transverse wall extends from one leg to the other leg within the bite of the C-shaped dome and upwardly from the lower section to a location above the central area and below the upper sections so as to define a raised rib across the bite. A recloseable flip-open segment forms part of the lower section and extends inwardly from a location on the annular channel to a hinge line on the bottom section. The flip-open segment can be separated from the remainder of the lower section and flipped open along the hinge line in a direction towards the wall.

5 Claims, 2 Drawing Sheets

DOME LID FOR DRINKING CUP

BACKGROUND OF INVENTION

Disposable plastic lids are in common use as closures for drinking cups and most notably, coffee cups. A common feature of these type of lids is that they also include a tear-away or flip-open segment which permits one to sip a beverage through the torn away or flipped-open area created in the lid when it is otherwise in its closure position on a drinking cup.

A typical disposable cup cover or lid is disclosed in U.S. Pat. No. 4,202,459 issued May 13, 1980—DeParales et al and which includes a hinged flip-open segment that can be manually separated from the remainder of the lid to facilitate drinking of the beverage in the cup through the opening created in the lid while the lid remainder is still physically attached to the rim of the cup. The hinged segment in its separated condition can be held open in a fixed position by co-operating means provided in the lid itself, and should it be desired, the separated segment can also be flipped back to its original position to minimize beverage spillage if the cup is tilted or shaken.

A variation on lids of the foregoing description are lids which characteristically have interior of its lower section of that includes a downwardly facing annular channel for receiving and engaging the rim of a drinking cup, an upper or top wall section which is raised relative to the lower section. Lids which exhibit this raised feature are commonly known in the industry as "dome" lids.

One notable and desirable characteristic of dome disposable lids is their ability, when positioned as a closure on the rim of a drinking cup, to accommodate the foam or froth which may appear above the upper surface of the liquid contained within the cup, and which is typical of specialty coffees that have a foaming head.

Clements in Canadian Patent 1,229,576 issued Nov. 24, 1987 discloses a dome lid having a raised top wall that has a generally circular periphery and an annular sidewall which depends therefrom to a lower section of the lid which itself has a downwardly facing annular channel for engaging the circular rim of a drinking cup to which it is attached. Included in the top wall is a recessed portion for receiving the upper lip of a person drinking from the cup. In the peripheral portion of the top wall adjacent the recess, an opening or passageway is provided to enable one drinking from the cup to do so without removing the lid from the cup. While in the Clements patent it was acknowledged that flip-up segments in disposable lids were known, this desirable feature formed no part of his dome lid construction. Indeed, given the existence of the opening or passageway in the lid as disclosed by Clements, it was not capable of functioning as a complete closure for spillage purposes.

In accordance with the novel dome lid of my invention, I have been able to maintain the desirable features inherent in dome lid designs, while enabling it to function as a complete closure lid and optionally, as a drink through lid employing a recloseable flip-open lid segment for this purpose.

SUMMARY OF THE INVENTION

In accordance with this invention, the plastic dome lid which is intended for use as a closure on a drinking cup is characterized by a lower section which includes a downwardly facing annular channel for receiving and engaging the rim of a drinking cup; an upper section which includes a raised "C" shaped or horseshoe shaped dome; an intermediate section which includes a central area located within and depressed relative to said "C" or horseshoe shaped dome; a wall which extends transversely from one leg to the other leg within the bite of said "C" or horseshoe shaped dome and upwardly from said lower section to a location above said central area and below said upper section so as to define a raised rib across said bite; and a recloseable flip-open segment forming part of said lower section and which extends inwardly from a location on said annular channel to a hinge line on said bottom section so that the segment can be manually separated from the remainder of the lower section and flipped open along said hinge line in a direction towards said wall.

By providing a recloseable flip-open segment in the lower section of the dome lid, the segment can be separated from the remainder of the lid so as to permit one to drink through the opening created in the lid and if desired, to re-close the opening. Foam or froth from the beverage as it rises is accommodated within the exterior of the raised "C" or horseshoe shaped dome. The intermediate section which is depressed relative to the "C" shaped dome, when the flip-open segment is separated from the remainder of the lid advantageously permits both the drinking cup and accompanying dome lid to be tilted further before the intermediate section contacts the nose of the person drinking through the lid.

The flip-open segment can itself include means for maintaining it in its open state when in its flipped open condition and can also be provided with a finger tab which projects laterally outwardly from the segment at its location on the annular channel, to assist in separating the segment for drink through lid purposes. Further, and as is the case with disposable lids that are not dome lids, the dome lid of this invention can also include lines of weakness in its lower section so as to enable the flip-open segment to be separated from its surrounding. As is also known in the art, a vent hole can be provided in the lid, preferably in the intermediate section so as to provide venting for the beverage within the cup and to also enable liquid which may have passed therethrough to return to the cup via the vent opening. The purpose of the rib which extends across in the bite above the intermediate section in addition to imparting additional strength to the lid in its central area, is to retain any beverage which passes through the vent in the area of the intermediate section and to enable it to drain back into the beverage cup through the vent opening.

DETAILED DESCRIPTION OF DRAWINGS

Figure 1:
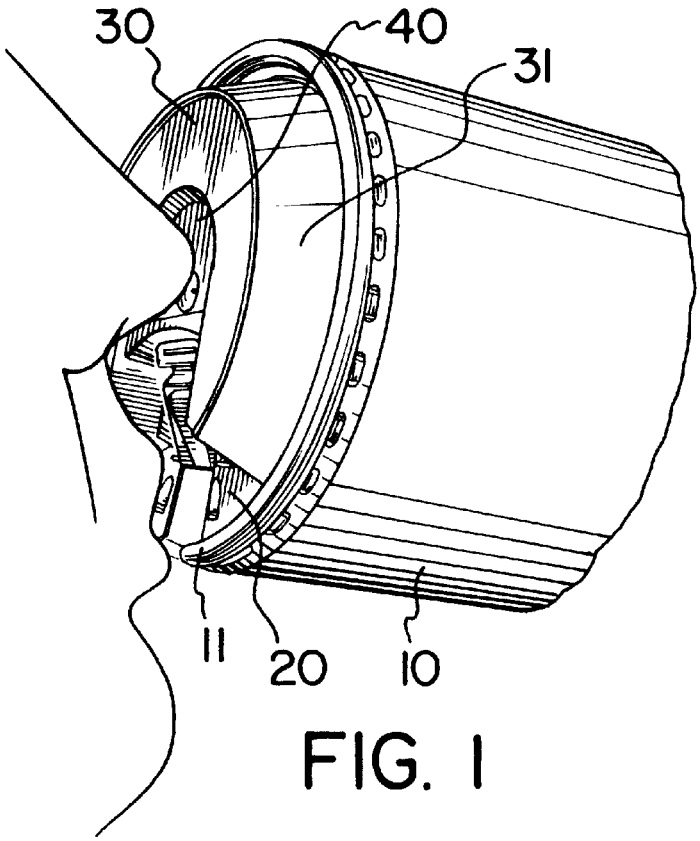
FIG. 1 is a perspective view of the dome lid of the present invention, shown attached to the open end of a drinking cup and also showing the engagement of a user's mouth with the lid.
Figure 4:
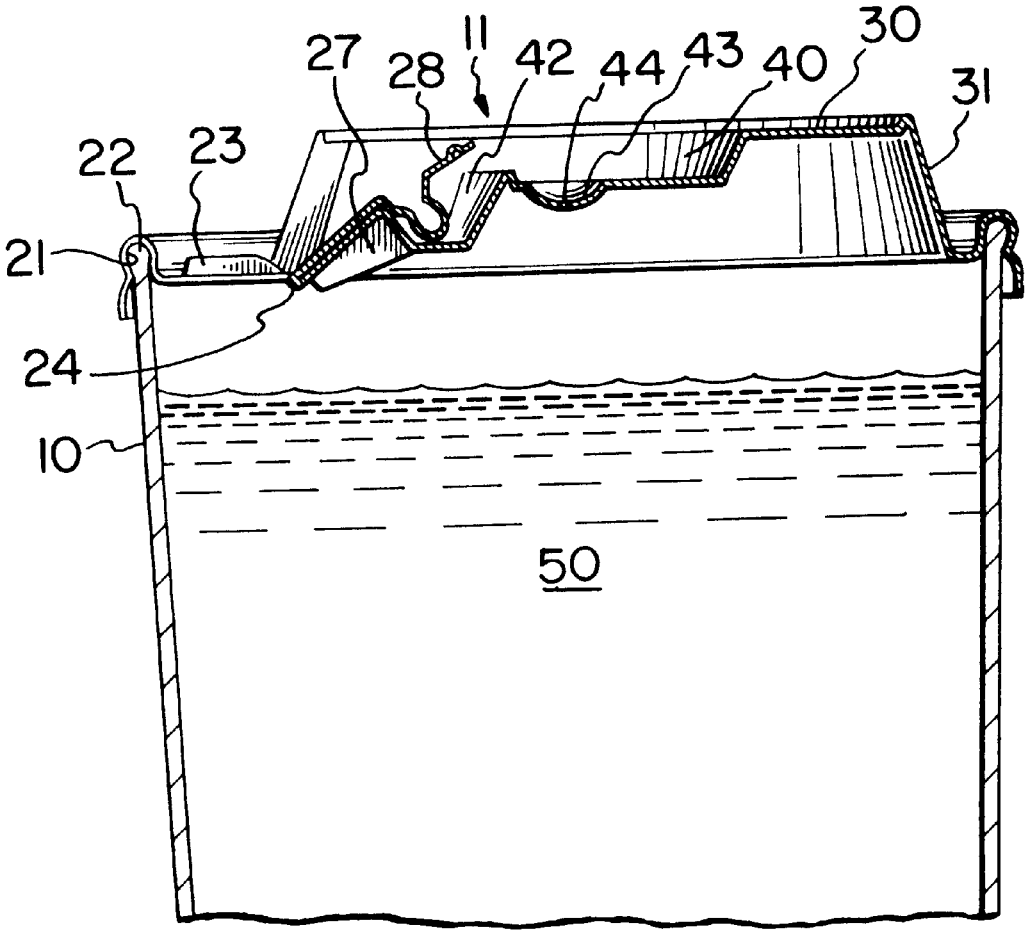
FIG. 4 is a similar cross-sectional view of that of FIG. 3 and which additionally, illustrates the flip-open segment in its fully opened position and the lid attached to a drinking cup.

In FIGS. 1 and 4, the novel dome lid 11 is shown attached to a drinking vessel such as coffee cup 10.

Figure 2:
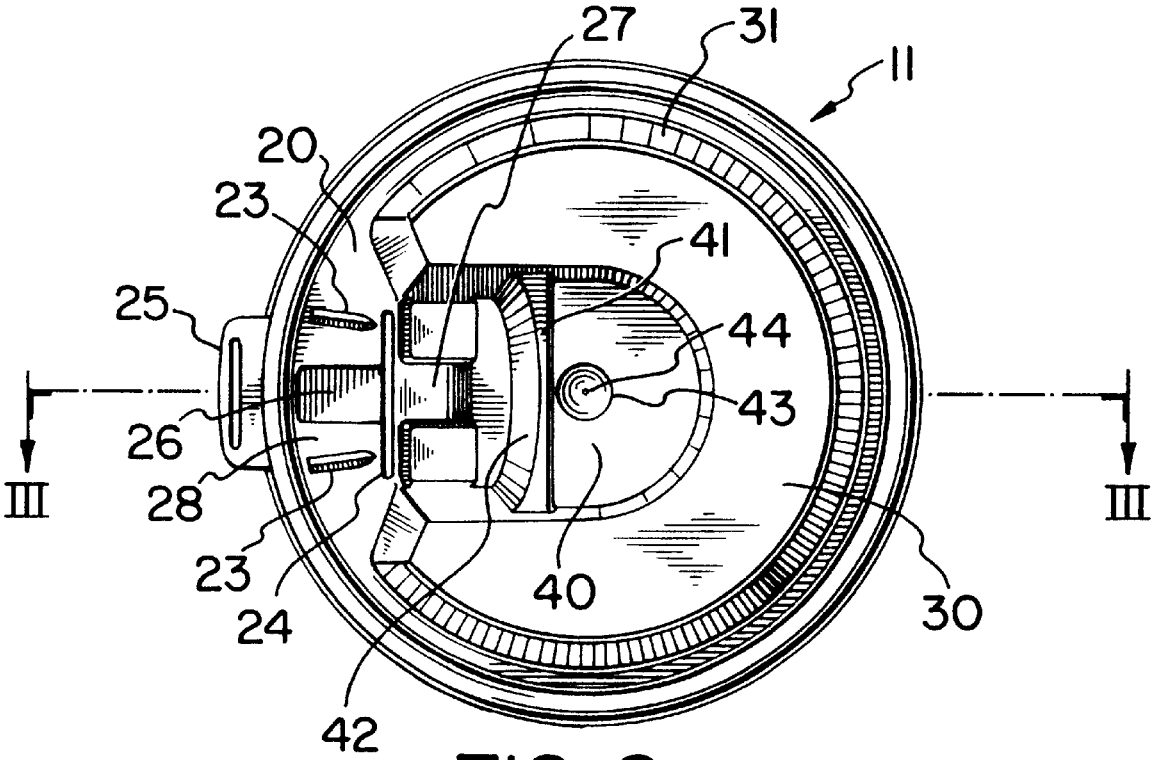
FIG. 2 is a plan view of the lid of FIG. 1.
Figure 3:
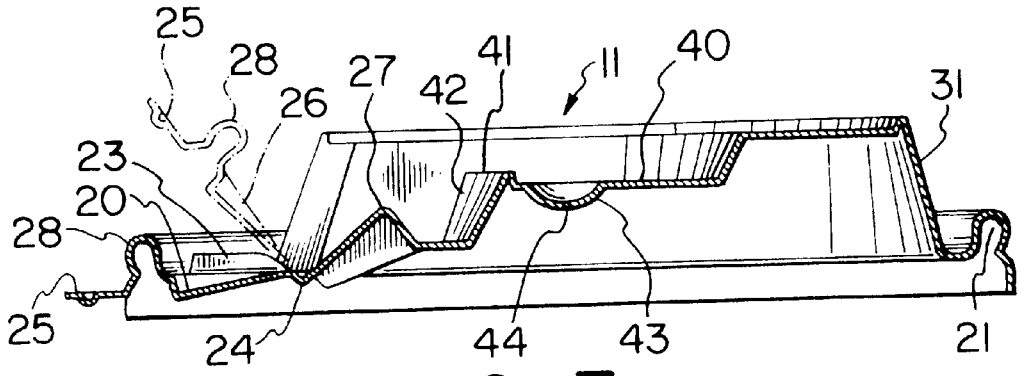
FIG. 3 is a cross-sectional view taken along the lines III—III of FIG. 2 and which also illustrates in broken line the flip-open segment when in its partially opened position.

Dome lid 11 is formed or molded from any suitable plastic material such as polystyrene. As best seen in FIGS. 2 and 3, the lower section 20 of lid 11 includes a downwardly facing annular channel 21 the purpose of which is to grasp and secure the lid to rim 22 of cup 10 in a manner well known in the art. Upper section 30 of lid 11 has the appearance of a raised C-shaped or horseshoe shaped dome which includes surrounding sidewalls 31.

Interior of the bite of the C-shaped dome 30 is intermediate section 40 which is depressed relative to the C-shaped dome. Wall 42 extends transversely from one leg to the other leg within the bite of the dome and upwardly from lower section 20 to a location above intermediate section 40 and below upper section 30 so as to define a raised rib 41 extending across the bite.

As previously mentioned, the novel dome lid of this invention includes a provision for recloseable flip-up segment 28 in order to enable a person to drink through the lid while the lid remainder is attached to a drinking cup, and which is illustrated in its fully opened condition 28 in FIG. 4 and in its partially flip-open condition seen in broken line in FIG. 3.

With reference to FIG. 2, the flip-open segment which is an integral part of the lid at the time it is formed or molded, is delineated by lifting tab 25, elongate tent shaped ribs 23, and hinge line 24. Upon manually lifting or flipping tab 25 upwardly, the lid is caused to fracture initially on either side of the tab with the fractures migrating in a direction towards hinge 24 along tent shaped ribs which direct the fractures linearly towards the hinge line, since the apex of each tent-like rib constitutes a line of weakness in the lid and which is created at the time the lid is formed. It will also be apparent to those skilled in the art that lines of weakness in the lower section of the lid can be also created through the use of scoring lines or perforations (not shown).

As best illustrated in FIG. 2, flip-open segment 28 is provided with a depressed area 26. On the opposite side of hinge line 24 is raised projection 28 and which is dimensioned so as to receive depression 26 when segment 28 is separated from the remainder of the lid and pivoted along hinge line 28 so that depression 26 and projection 27 frictionally engage one another to hold the flip-open segment in its fully opened condition as seen in FIG. 4. FIG. 4 also shows the additional volume created above liquid 50 in cup 10 when dome lid 11 is attached to rim 11 of the cup.

As also illustrated in FIGS. 2, 3 and 4, a depression 43 having a central vent hole 44 is provided in intermediate section 40 of the dome lid. Beverage in a cup which passes upwardly through vent 40 initially collects in depression 43 and in the event of overflow, is contained within the intermediate section 40 by virtue of the existence of rib 42 and the surrounding portion of the raised dome.

Once the flip-open segment 28 is opened, beverage from the cup can be sipped through the opening in the lid and both the cup 10 and dome lid 11 can be tilted higher than normal before hitting a person's nose due to the intermediate section 40 being depressed relative to the raised C-shaped or horseshoe shaped dome 30, as best seen with reference to FIG. 1.

I claim:

1. A one-piece plastic dome lid for use as a closure on a drinking cup, said dome lid being characterized by:

a. a lower section which includes a downwardly facing annular channel for receiving and engaging a rim of said drinking cup;

b. an upper section which includes a raised C-shaped dome;

c. an intermediate section which includes a central area located within and depressed relative to said C-shaped dome;

d. a wall which extends transversely from one leg to an other leg within a bite of said C-shaped dome and upwardly from said lower section to a location above said central area and below said upper section so as to define a raised rib across said bite; and e. a recloseable flip-open segment forming part of said lower section and which extends inwardly from a location on said annular channel to a hinge line on said lower section, said flip-open segment being capable of manual separation from the remainder of said lower section and flipped open along said hinge line in a direction towards said wall.

2. The plastic dome lid as claimed in claim 1, including means for maintaining said flip-open segment open when in said flipped open condition.

3. The plastic dome lid as claimed in claim 1, said flip-open segment includes a finger tab projecting laterally outwardly from said location on said annular channel.

4. The plastic dome lid as claimed in claim 3, wherein said manual separation of said flip-open segment from the remainder of said lower section takes place along lines of weakness provided in said lower section and which extend between said tab and said hinge line.

5. The plastic dome lid as claimed in claim 4, wherein said intermediate section includes a vent hole extending therethrough.

* * * * *